US010032554B2

(12) United States Patent
Lee et al.

(10) Patent No.: US 10,032,554 B2
(45) Date of Patent: Jul. 24, 2018

(54) DETACHABLE TRANSFORMER

(71) Applicant: MEAN WELL (GuangZhou) Electronics Co., Ltd., Guangzhou (CN)

(72) Inventors: Yu-Hsiang Lee, New Taipei (TW); Chen-Feng Chang, New Taipei (TW)

(73) Assignee: MEAN WELL (GUANGZHOU) ELECTRONICS CO., LTD., Guangzhou (CN)

( * ) Notice: Subject to any disclaimer, the term of this patent is extended or adjusted under 35 U.S.C. 154(b) by 15 days.

(21) Appl. No.: 15/234,296

(22) Filed: Aug. 11, 2016

(65) Prior Publication Data

US 2018/0047501 A1 Feb. 15, 2018

(51) Int. Cl.

| | |
|---|---|
| ***H01F 27/30*** | (2006.01) |
| ***H01F 27/34*** | (2006.01) |
| ***H01F 27/32*** | (2006.01) |
| ***H01F 27/28*** | (2006.01) |
| ***H01F 27/24*** | (2006.01) |
| ***H01F 29/00*** | (2006.01) |

(52) U.S. Cl.

CPC ..... *H01F 27/34* (2013.01); *H01F 27/24* (2013.01); *H01F 27/2823* (2013.01); *H01F 27/325* (2013.01); *H01F 29/00* (2013.01); *H01F 2027/348* (2013.01)

(58) Field of Classification Search

CPC ..... H01F 27/306; H01F 27/325; H01F 5/02

USPC ..... 336/196, 198, 208

See application file for complete search history.

(56) References Cited

U.S. PATENT DOCUMENTS

| | | | | |
|---|---|---|---|---|
| 2005/0068149 | A1* | 3/2005 | Fushimi | H01F 27/306 336/208 |
| 2012/0154089 | A1* | 6/2012 | Eom | H01F 27/30 336/105 |
| 2012/0286919 | A1* | 11/2012 | Maeda | H01F 5/02 336/212 |
| 2013/0154787 | A1* | 6/2013 | Maeda | H01F 5/00 336/220 |

* cited by examiner

*Primary Examiner* — Tsz Chan

(74) *Attorney, Agent, or Firm* — Muncy, Geissler, Olds & Lowe, P.C.

(57) ABSTRACT

A detachable transformer includes a first bobbin, a primary winding, a second bobbin, a secondary winding and a magnetic core set. The magnetic core set peripherally surrounds the first bobbin and the second bobbin and is inserted into them. A top and a bottom of the first bobbin respectively have a first winding recess and an installation recess. The primary winding is arranged in the first winding recess. A side of the installation recess has a first opening connecting with an external space. A top of the second bobbin has a second winding recess. The secondary winding is arranged in the second winding recess. The second bobbin is arranged in the installation recess through the first opening, whereby the first bobbin and the second bobbin form a detachable connection.

8 Claims, 7 Drawing Sheets

DETACHABLE TRANSFORMER

BACKGROUND OF THE INVENTION

Field of the Invention

The present invention relates to a transformer, particularly to a detachable transformer.

Description of the Related Art

With the development and evolution of electronic produces, different electronic produces are driven by different power devices. Thus, the industries of the power devices actively try to develop various transformer structures and apply them to various power supplies.

A simple transformer consists of a first conductor and a second conductor. When a varying current flows through the first conductor, a varying magnetic field impinges on the first conductor. Then, based on the electromagnetic mutual induction principle, the varying magnetic field induces a varying electromotive force (EMF) or voltage in the second conductor, thereby establishing a voltage drop between the first conductor and the second conductor. With the development of technology products, the transformers are not only used to vary the EMF, but also minimized, whereby the transformers are installed in various electronic devices or welded to circuit boards. As a result, the transformer structure is endlessly improved, and the transformer consists of a base, a set of primary coils, a set of secondary coils and an iron core set. The transformer can usually output a voltage of 2.8~48 V and the voltage range is large. If the windings of the transformer are formed by wires, the winding corresponding to large current is difficult to manufacture, and its output pins having large volumes are not easy to manufacture. Besides, the wires for large current are thicker and difficult to wind around the pins. The thick wires are wound around the pins whereby a height of the transformer is increased. Even the thick wires are wound around the pins, the large current flowing through the circuit board can still cause loss. In addition, in a low profile power supply, a top of a horizontal transformer does not have a magnetic core. Hence, the transformer and a conduction case above can cause eddy current loss.

To overcome the abovementioned problems, the present invention provides a detachable transformer, so as to solve the afore-mentioned problems of the prior art.

SUMMARY OF THE INVENTION

A primary objective of the present invention is to provide a detachable transformer, which installs a second bobbin in an installation recess of a first bobbin to form a detachable vertical connection, whereby the second bobbin is replaced according to the requirement, thereby achieving fast manufacture, low cost, mass production of minimization and low eddy current loss.

To achieve the abovementioned objectives, the present invention provides a detachable transformer, which comprises a first bobbin, a primary winding, a second bobbin, a secondary winding and a magnetic core set, wherein the primary winding is formed by conduction wires. A center of the first bobbin is penetrated with a first through hole, and a top and a bottom of the first bobbin respectively have a first winding recess and an installation recess. The first winding recess surrounds the first through hole, and the primary winding is arranged in the first winding recess. The installation recess connects with the first through hole. A side of the installation recess has a first opening connecting with an external space. A partial edge of the bottom of the first bobbin horizontally extends to form a first blocking board portion abutting against a bottom of the second bobbin. A center of the second bobbin is penetrated with a second through hole. A top of the second bobbin has a second winding recess surrounding the second through hole. The secondary winding is arranged in the second winding recess. The second bobbin is arranged in the installation recess through the first opening, and the first through hole connects with the second through hole, whereby the first bobbin and the second bobbin form a detachable connection. A part of the bottom of the second bobbin vertically and downward extends to form a second blocking board portion abutting against the first blocking board portion. An edge of the second bobbin corresponding to the first opening is provided with a plurality of indentations and a plurality of pins. The magnetic core set peripherally surrounds the first bobbin and the second bobbin and extends to the first through hole and second through hole.

The magnetic core set further comprises a first magnetic core and a second magnetic core. The first magnetic core abuts against the first bobbin and extends to the first through hole. The second magnetic core abuts against the second bobbin, extends to the second through hole and connects with the first magnetic core to surround the first bobbin and the second bobbin.

In the first embodiment, the second winding recess is a circular recess, and the secondary winding is formed by conduction wires.

In the second embodiment, a side of the second winding recess further has a second opening connecting with the external spice and the first opening. The secondary winding further comprises a first conduction plate, a second conduction plate, a third conduction plate and a fourth conduction plate, such as copper plates. The first conduction plate has a first curved portion, and two ends of the first curved portion extend to respectively form a first electrode portion and a second electrode portion, and a horizontal height of the first electrode portion is higher than that of the second electrode portion, and the first electrode portion and the second electrode portion are respectively provided with a first locking hole and a second locking hole, and the first curved portion is arranged in the second winding recess, and the first electrode portion and the second electrode portion emerge from the second opening. The second conduction plate has a second curved portion, and two ends of the second curved portion extend to respectively form a third electrode portion and a fourth electrode portion, and horizontal heights of the first electrode portion, the third electrode portion and the fourth electrode portion are identical, and the third electrode portion and the fourth electrode portion are respectively provided with a third locking hole and a fourth locking hole, and the second curved portion is arranged on the first curved portion, and the second curved portion abuts against the first curved portion, the second curved portion is arranged in the second winding recess, and the third electrode portion and the fourth electrode portion emerge from the second opening, and the third electrode portion is arranged on the second electrode portion, and the third electrode portion abuts against the second electrode portion. The third conduction plate has a third curved portion, and two ends of the third curved portion extend to respectively form a fifth electrode portion and a sixth electrode portion, and horizontal heights of the fifth electrode portion and the sixth electrode portion are identical, and the fifth electrode portion and the sixth electrode portion are respectively provided with a fifth locking hole and a sixth locking hole, and the third curved portion is arranged on the second curved portion, and the third curved portion abuts against the second curved portion, the third curved portion is arranged in the second winding recess, and the fifth electrode portion and the sixth electrode portion emerge from the second opening, and the fifth electrode portion and the sixth electrode portion are respectively arranged on the first electrode portion and the third electrode portion, and the fifth electrode portion and the sixth electrode portion respectively abut against the first electrode portion and the third electrode portion. The fourth conduction plate has a fourth curved portion, and two ends of the fourth curved portion extend to respectively form a seventh electrode portion and a eighth electrode portion, and a horizontal height of the seventh electrode portion is higher than that of the eighth electrode portion, and the seventh electrode portion and the eighth electrode portion are respectively provided with a seventh locking hole and a eighth locking hole, and the fourth curved portion is arranged on the third curved portion, and the fourth curved portion abuts against the third curved portion, and the fourth curved portion is arranged in the second winding recess, and the seventh electrode portion and the eighth electrode portion emerge from the second opening, and the seventh electrode portion and the eighth electrode portion are respectively arranged on the sixth electrode portion and the fourth electrode portion, and the seventh electrode portion and the eighth electrode portion respectively abut against the sixth electrode portion and the fourth electrode portion.

Below, the embodiments are described in detail in cooperation with the drawings to make easily understood the technical contents, characteristics and accomplishments of the present invention.

DETAILED DESCRIPTION OF THE INVENTION

Figure 1:
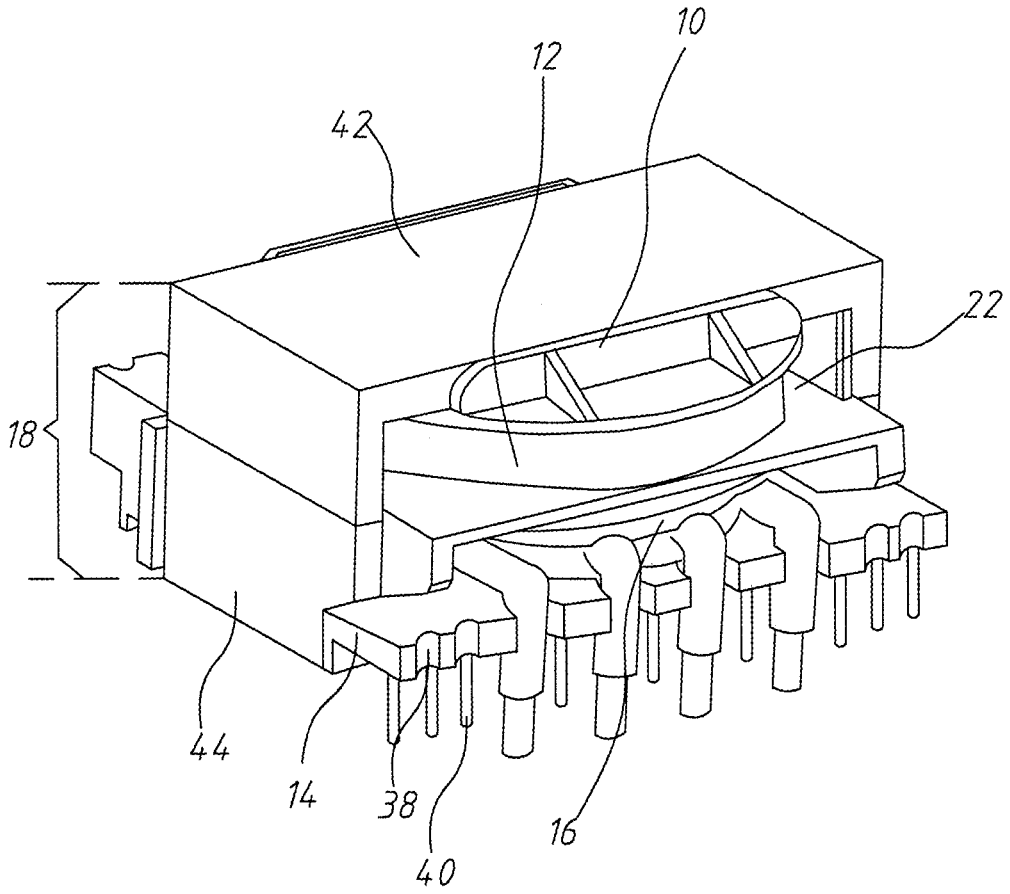
FIG. 1 is a perspective view of a detachable transformer according to the first embodiment of the present invention.

Reference will now be made in detail to embodiments illustrated in the accompanying drawings. Wherever possible, the same reference numbers are used in the drawings and the description to refer to the same or like parts. In the drawings, the shape and thickness may be exaggerated for clarity and convenience. This description will be directed in particular to elements forming part of, or cooperating more directly with, methods and apparatus in accordance with the present disclosure. It is to be understood that elements not specifically shown or described may take various forms well known to those skilled in the art. Many alternatives and modifications will be apparent to those skilled in the art, once informed by the present disclosure.

Figure 2:
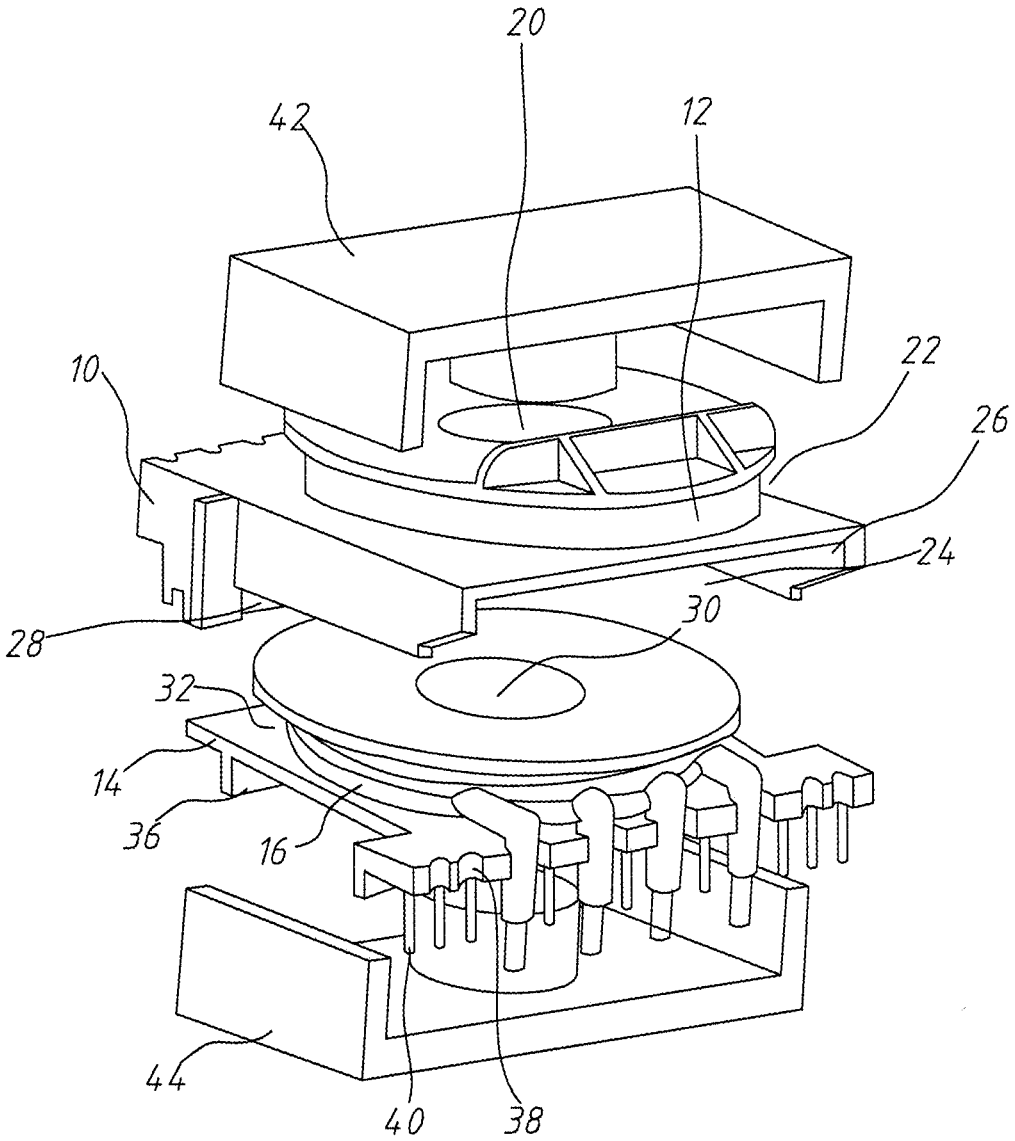
FIG. 2 is an exploded view of a detachable transformer according to the first embodiment of the present invention.
Figure 3:
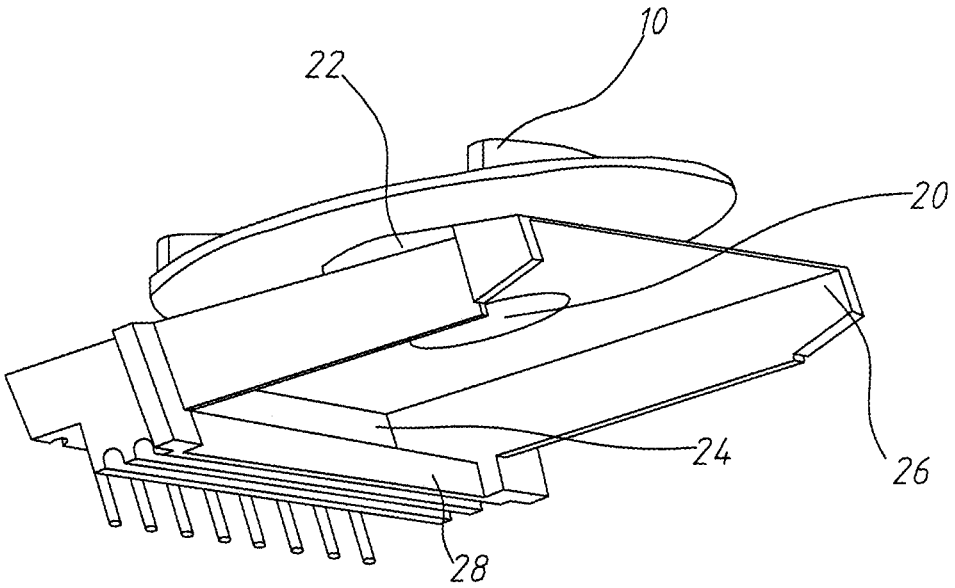
FIG. 3 is a perspective view of a first bobbin according to an embodiment of the present invention.
Figure 4:
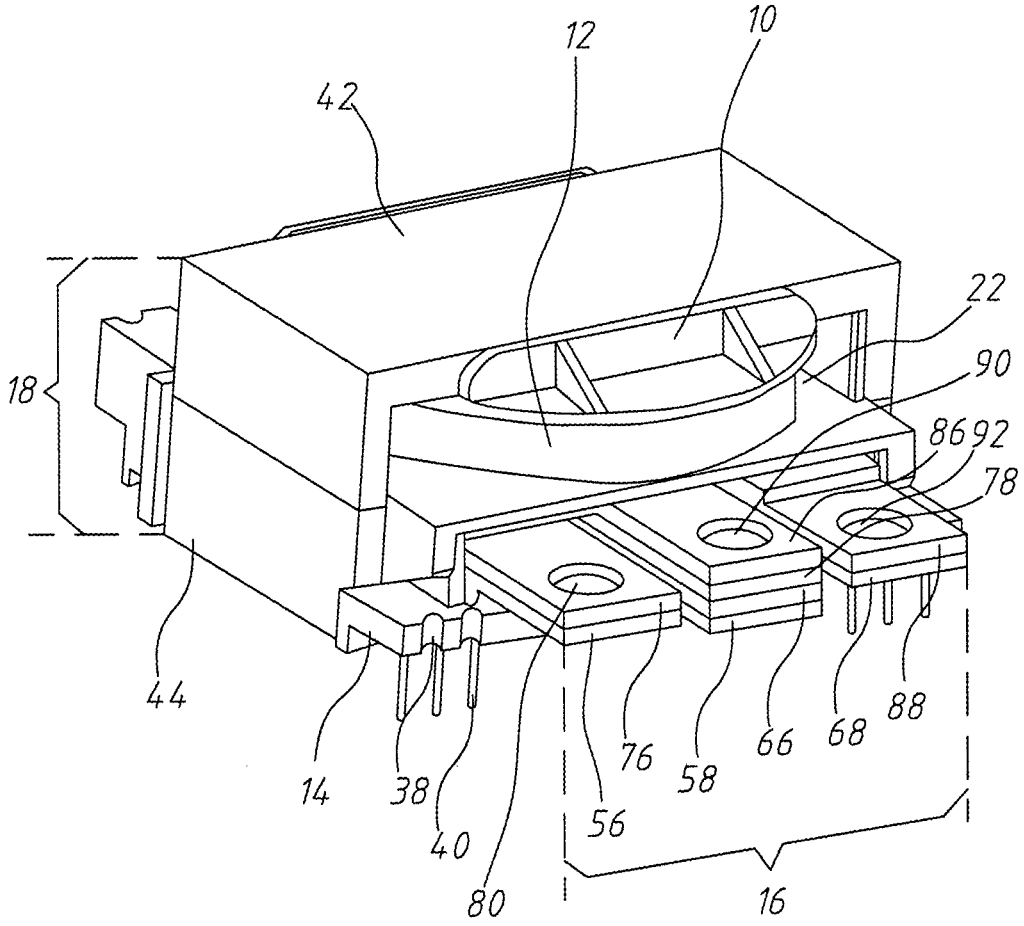
FIG. 4 is a perspective view of a detachable transformer according to the second embodiment of the present invention.
Figure 5:
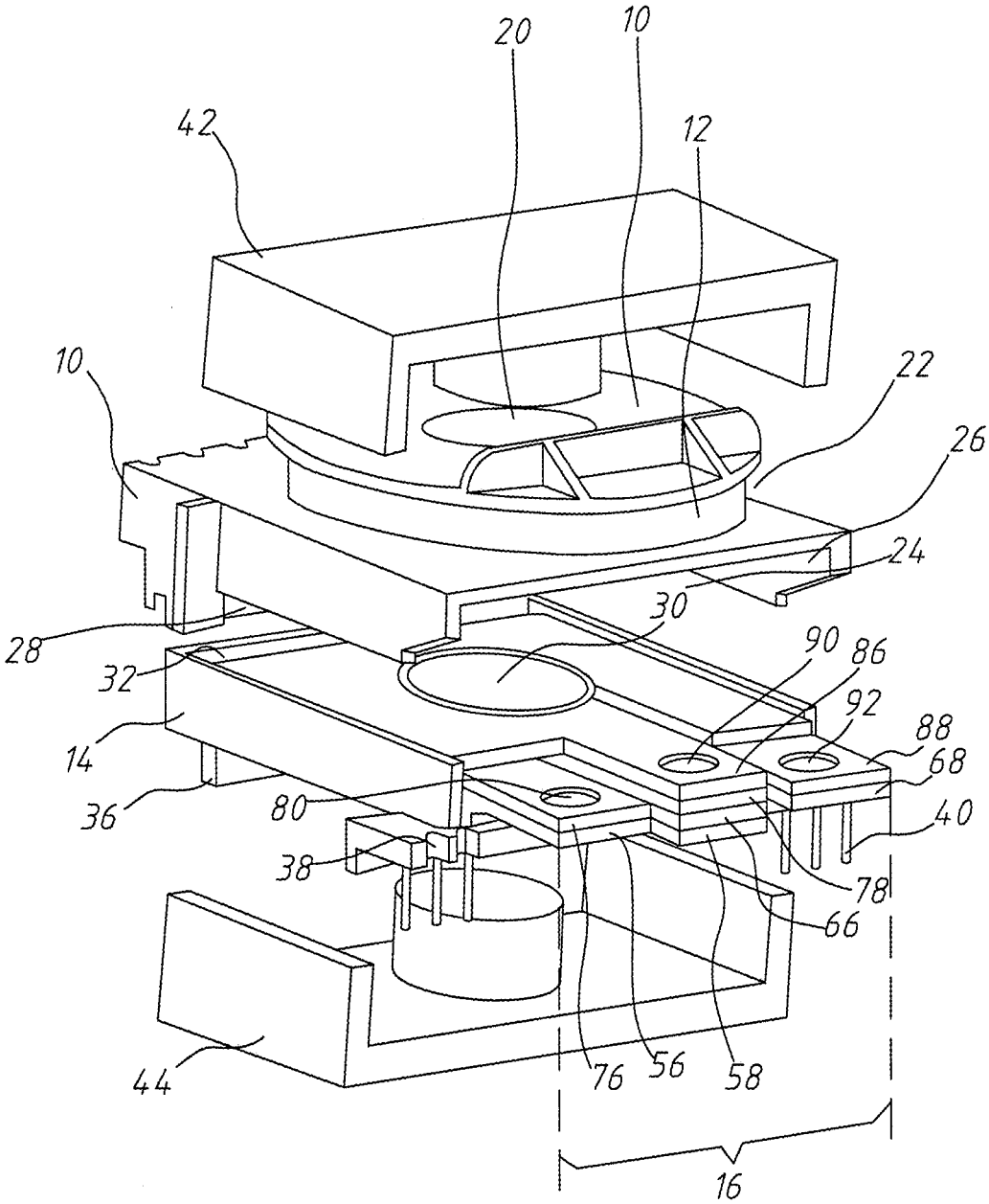
FIG. 5 is an exploded view of a detachable transformer according to the second embodiment of the present invention.
Figure 6:
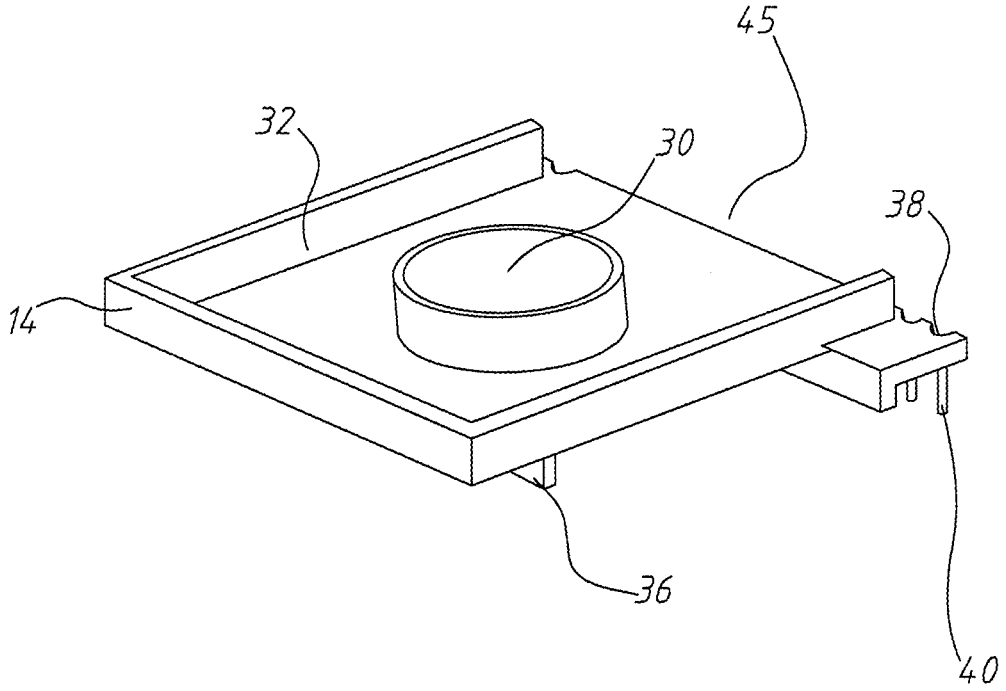
FIG. 6 is a perspective view of a second bobbin according to the second embodiment of the present invention.
Figure 7:
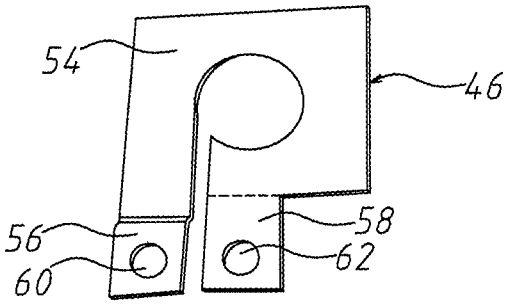
FIG. 7 is a perspective view of a first conduction plate according to an embodiment of the present invention.
Figure 8:
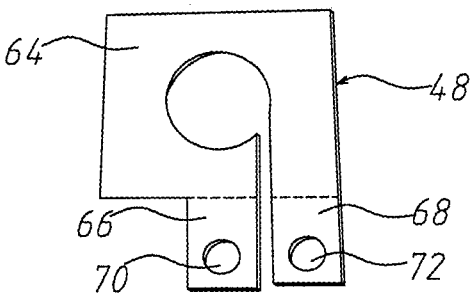
FIG. 8 is a perspective view of a second conduction plate according to an embodiment of the present invention.
Figure 9:
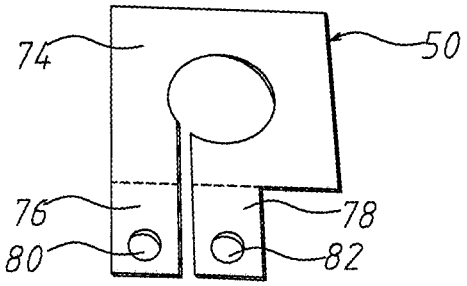
FIG. 9 is a perspective view of a third conduction plate according to an embodiment of the present invention.
Figure 10:
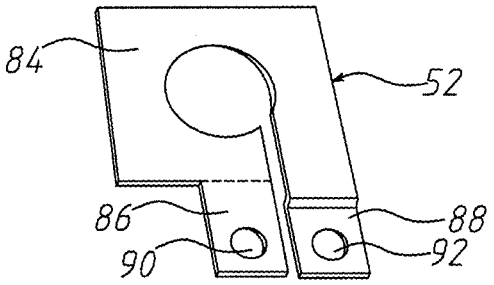
FIG. 10 is a perspective view of a fourth conduction plate according to an embodiment of the present invention.

Refer to FIG. 1, FIG. 2 and FIG. 3. The detachable transformer of the first embodiment of the present invention is introduced as below. The first embodiment is used to output high voltage and low current. For example, the low current has a range of 5~30 A. The detachable transformer of the first embodiment of the present invention comprises a first bobbin 10, a primary winding 12, a second bobbin 14, a secondary winding 16 and a magnetic core set 18, wherein the primary winding 12 is formed by conduction wires. A center of the first bobbin 10 is penetrated with a first through hole 20, and a top and a bottom of the first bobbin 10 respectively have a first winding recess 22 and an installation recess 24. The first winding recess 22 surrounds the first through hole 20, and the primary winding 12 is arranged in the first winding recess 22. The conduction wires of the primary winding 12 consisting of a specific number of turns are wound in the first winding recess 22 according to the requirement. The installation recess 24 connects with the first through hole 20. A side of the installation recess 24 has a first opening 26 connecting with an external space. A partial edge of the bottom of the first bobbin 10 horizontally extends to form a first blocking board portion 28 abutting against a bottom of the second bobbin 14. A center of the second bobbin 14 is penetrated with a second through hole 30. A top of the second bobbin 14 has a second winding recess 32 surrounding the second through hole 30. The secondary winding 16 is arranged in the second winding recess 32. The second bobbin 14 is arranged in the installation recess 24 through the first opening 26, and the first through hole 20 connects with the second through hole 30, whereby the first bobbin 10 and the second bobbin 14 form a detachable connection. A part of the bottom of the second bobbin 14 vertically and downward extends to form a second blocking board portion 36 abutting against the first blocking board portion 28. From the figures, it can be seen that a block is protruded from a back side of the second blocking board portion 36. The space above the first blocking board portion 28 can accommodate the protruding block to achieve preliminary positioning. Besides, the second blocking board portion 36 abuts against the first blocking board portion 28, so that the first through hole 20 corresponds to the second through hole 30. After assembling the magnetic core set 18, the first bobbin 10 is stably combined with the second bobbin 14. On the contrary, after disassembling the magnetic core set 18, the second bobbin 14 is easily replaced, thus, manufacture efficiency, low cost and assembling convenience can be achieved. An edge of the second bobbin 14 corresponding to the first opening 26 is provided with a plurality of indentations 38 and a plurality of pins 40. In the first embodiment, the second winding recess 32 is a circular recess, and the secondary winding 16 is formed by conduction wires. The conduction wires are wound around the pins 40 through the indentations 38. The pins 40 are inserted in a circuit board whereby the low current flows to the circuit board through the conduction wires. The magnetic core set 18 peripherally surrounds the first bobbin 10 and the second bobbin 14 and extends to the first through hole 20 and second through hole 30. The magnetic core set 18 further comprises a first magnetic core 42 and a second magnetic core 44. The first magnetic core 42 abuts against the first bobbin 10. A central column of the first magnetic core 42 extends to the first through hole 20, and two sides of the first magnetic core 42 downward extend along the first bobbin 10. The second magnetic core 44 abuts against the second bobbin 14. A central column of the second magnetic core 44 extends to the second through hole 30, and two sides of the second magnetic core 44 upward extend along the second bobbin 14 to connect with the first magnetic core 42. The first magnetic core 42 and the second magnetic core 44 surround the first bobbin 10 and the second bobbin 14. The sides of the first magnetic core 42 and the second magnetic core 44 are manufactured to form the central columns and the two side surfaces in one piece at one time. It saves time as the manufacture of the first magnetic core 42 and the second magnetic core 44 is completed in a step. In a power supply, the detachable transformer of the present invention is arranged on a circuit board, and then a power case made of conduction material is used to cover the power supply. In general, in order to reduce eddy current loss between drift of magnetic flux and the power case, a vertical transformer is used. However, the vertical transformer is too high to apply to a power case with low height, such as a power case with height of 1 U (unit). 1 U equals to 1.75 inches. The detachable transformer of the present invention is a vertical transformer whose structure is flat enough and installed in a power case with low height to reduce eddy current loss between drift of magnetic flux and the power case.

Refer to FIG. 3, FIG. 4, FIG. 5, FIG. 6, FIG. 7, FIG. 8, FIG. 9 and FIG. 10. The detachable transformer of the second embodiment of the present invention is introduced as below. The second embodiment is used to output low voltage and high current. For example, the high current has a range of larger than 40 A. The second embodiment is different from the first embodiment in the secondary winding 16 and the second winding recess 32. In the second embodiment, a side of the second winding recess 32 further has a second opening 45 connecting with the external space and the first opening 26.

The secondary winding 16 further comprises a first conduction plate 46, a second conduction plate 48, a third conduction plate 50 and a fourth conduction plate 52. For example, the first conduction plate 46, the second conduction plate 48, the third conduction plate 50 and the fourth conduction plate 52 are copper plates. The first conduction plate 46 has a first curved portion 54, and two ends of the first curved portion 54 extend to respectively form a first electrode portion 56 and a second electrode portion 58, and a horizontal height of the first electrode portion 56 is higher than that of the second electrode portion 58, and the first electrode portion 56 and the second electrode portion 58 are respectively provided with a first locking hole 60 and a second locking hole 62, and the first curved portion 54 is arranged in the second winding recess 32, and the first electrode portion 56 and the second electrode portion 58 emerge from the second opening 45. The second conduction plate 48 has a second curved portion 64, and two ends of the second curved portion 64 extend to respectively form a third electrode portion 66 and a fourth electrode portion 68. Horizontal heights of the first electrode portion 56, the third electrode portion 66 and the fourth electrode portion 68 are identical. The third electrode portion 66 and the fourth electrode portion 68 are respectively provided with a third locking hole 70 and a fourth locking hole 72. The second curved portion 64 is arranged on the first curved portion 54, and the second curved portion 64 abuts against the first curved portion 54. The second curved portion 64 is also arranged in the second winding recess 32, and the third electrode portion 66 and the fourth electrode portion 68 emerge from the second opening 45. The third electrode portion 66 is arranged on the second electrode portion 58, and the third electrode portion 66 abuts against the second electrode portion 58. The third conduction plate 50 has a third curved portion 74, and two ends of the third curved portion 74 extend to respectively form a fifth electrode portion 76 and a sixth electrode portion 78, and horizontal heights of the fifth electrode portion 76 and the sixth electrode portion 78 are identical. The fifth electrode portion 76 and the sixth electrode portion 78 are respectively provided with a fifth locking hole 80 and a sixth locking hole 82. The third curved portion 74 is arranged on the second curved portion 64, and the third curved portion 74 abuts against the second curved portion 64. The third curved portion 74 is arranged in the second winding recess 32, and the fifth electrode portion 76 and the sixth electrode portion 78 emerge from the second opening 45. The fifth electrode portion 76 and the sixth electrode portion 78 are respectively arranged on the first electrode portion 56 and the third electrode portion 66, and the fifth electrode portion 76 and the sixth electrode portion 78 respectively abut against the first electrode portion 56 and the third electrode portion 66. The fourth conduction plate 52 has a fourth curved portion 84, and two ends of the fourth curved portion 84 extend to respectively form a seventh electrode portion 86 and a eighth electrode portion 88, and a horizontal height of the seventh electrode portion 86 is higher than that of the eighth electrode portion 88, and the seventh electrode portion 86 and the eighth electrode portion 88 are respectively provided with a seventh locking hole 90 and a eighth locking hole 92. The fourth curved portion 84 is arranged on the third curved portion 74, and the fourth curved portion 84 abuts against the third curved portion 74. The fourth curved portion 84 is arranged in the second winding recess 32, and the seventh electrode portion 86 and the eighth electrode portion 88 emerge from the second opening 45. The seventh electrode portion 86 and the eighth electrode portion 88 are respectively arranged on the sixth electrode portion 78 and the fourth electrode portion 68, and the seventh electrode portion 86 and the eighth electrode portion 88 respectively abut against the sixth electrode portion 78 and the fourth electrode portion 68. Since the first conduction plate 46, the second conduction plate 48, the third conduction plate 50 and the fourth conduction plate 52 have similar shapes, they can be manufactured by one mold, thus reducing the manufacture cost. In addition, the first curved portion 54, the second curved portion 64, the third curved portion 74 and the fourth curved portion 84 have the largest areas for heat dissipation, and apply to output the high current, so that winding output pins with large volumes can be avoided, the time of winding wires around the pins 40 can be saved as well. Furthermore, since the high current flowing through the circuit board can cause large loss, the circuit board is provided with conduction plates that directly connect with the outputs. The secondary winding 16 of the transformer of the present invention directly connects with the conduction plates, lest the high current flow through the circuit board to output. From the figures, the first conduction plate 46, the second conduction plate 48, the third conduction plate 50 and the fourth conduction plate 52 use screws to directly lock the first locking hole 60, the second locking hole 62, the third locking hole 70, the fourth locking hole 72, the fifth locking hole 80, the sixth locking hole 82, the seventh locking hole 90 and the eighth locking hole 92 to a secondary rectifier, lest the high current flowing through the circuit board cause loss. The present invention replaces the second bobbin 14 and the secondary winding 16 according to the output requirement, so as to avoid re-manufacturing the first bobbin 10 and the primary winding 12, thereby achieving fast manufacture, low cost and production of minimization.

In conclusion, the present invention uses the first bobbin and the second bobbin to form a detachable and vertical connection, and replaces the second bobbin according to the output requirement, thereby achieving fast manufacture, low cost and mass production of minimization.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. A detachable transformer comprising:

a first bobbin with a center thereof penetrated with a first through hole, and a top and a bottom of said first bobbin respectively have a first winding recess and an installation recess, and said first winding recess surrounds said first through hole, and a side of said installation recess has a first opening connecting with an external space, and a partial edge of said bottom of said first bobbin opposite to said first opening horizontally extends to form a first blocking board portion, and said first blocking board portion and said bottom of said first bobbin form a space located therebetween;

a primary winding arranged in said first winding recess;

a second bobbin with a center thereof penetrated with a second through hole, and a top of said second bobbin has a second winding recess surrounding said second through hole, and said second bobbin is arranged in said installation recess through said first opening, and said first through hole connects with said second through hole, and a part of said bottom of said second bobbin vertically and downward extends to form a second blocking board portion abutting against said first blocking board portion, and a block is protruded from a side of said second blocking board portion, and said space between said bottom of said first bobbin and said first blocking board portion accommodates the block, and said first blocking board portion abuts against a bottom of said block, and said first blocking board portion positions said second bobbin;

a secondary winding arranged in said second winding recess; and a magnetic core set peripherally surrounding said first bobbin and said second bobbin and extending to said first through hole and second through hole.

2. The detachable transformer according to claim 1, wherein said primary winding is formed by conduction wires.

3. The detachable transformer according to claim 1, wherein a side of said second winding recess further has a second opening connecting with said external space and said first opening.

4. The detachable transformer according to claim 3, wherein said secondary winding further comprises:

a first conduction plate having a first curved portion, and two ends of said first curved portion extend to respectively form a first electrode portion and a second electrode portion, and a height of said first electrode portion is higher than that of said second electrode portion, and said first electrode portion and said second electrode portion are respectively provided with a first locking hole and a second locking hole, and said first curved portion is arranged in said second winding recess, and said first electrode portion and said second electrode portion emerge from said second opening;

a second conduction plate having a second curved portion, and two ends of said second curved portion extend to respectively form a third electrode portion and a fourth electrode portion, and heights of said first electrode portion, said third electrode portion and said fourth electrode portion are identical, and said third electrode portion and said fourth electrode portion are respectively provided with a third locking hole and a fourth locking hole, and said second curved portion is arranged on said first curved portion, and said second curved portion abuts against said first curved portion, said second curved portion is arranged in said second winding recess, and said third electrode portion and said fourth electrode portion emerge from said second opening, and said third electrode portion is arranged on said second electrode portion, and said third electrode portion abuts against said second electrode portion;

a third conduction plate having a third curved portion, and two ends of said third curved portion extend to respectively form a fifth electrode portion and a sixth electrode portion, and heights of said fifth electrode portion and said sixth electrode portion are identical, and said fifth electrode portion and said sixth electrode portion are respectively provided with a fifth locking hole and a sixth locking hole, and said third curved portion is arranged on said second curved portion, and said third curved portion abuts against said second curved portion, said third curved portion is arranged in said second winding recess, and said fifth electrode portion and said sixth electrode portion emerge from said second opening, and said fifth electrode portion and said sixth electrode portion are respectively arranged on said first electrode portion and said third electrode portion, and said fifth electrode portion and said sixth electrode portion respectively abut against said first electrode portion and said third electrode portion; and a fourth conduction plate having a fourth curved portion, and two ends of said fourth curved portion extend to respectively form a seventh electrode portion and a eighth electrode portion, and a height of said seventh electrode portion is higher than that of said eighth electrode portion, and said seventh electrode portion and said eighth electrode portion are respectively provided with a seventh locking hole and a eighth locking hole, and said fourth curved portion is arranged on said third curved portion, and said fourth curved portion abuts against said third curved portion, and said fourth curved portion is arranged in said second winding recess, and said seventh electrode portion and said eighth electrode portion emerge from said second opening, and said seventh electrode portion and said eighth electrode portion are respectively arranged on said sixth electrode portion and said fourth electrode portion, and said seventh electrode portion and said eighth electrode portion respectively abut against said sixth electrode portion and said fourth electrode portion.

5. The detachable transformer according to claim 4, wherein said first conduction plate, said second conduction plate, said third conduction plate and said fourth conduction plate are copper plates.

6. The detachable transformer according to claim 1, wherein an edge of said second bobbin corresponding to said first opening is provided with a plurality of indentations and a plurality of pins.

7. The detachable transformer according to claim 1, wherein said second winding recess is circular, and said secondary winding is formed by conduction wires.

8. The detachable transformer according to claim 1, wherein said magnetic core set further comprises:

a first magnetic core with a central column thereof extending to said first through hole, and two sides of said first magnetic core downward extend along said first bobbin; and a second magnetic core with a central column thereof extending to said second through hole, and two sides of said second magnetic core upward extend along said second bobbin to connect with said first magnetic core, and said first magnetic core and said second magnetic core surround said first bobbin and said second bobbin.

* * * * *